United States Patent [19]

Niekrasz et al.

[11] Patent Number: 4,578,902

[45] Date of Patent: Apr. 1, 1986

[54] REVERSIBLE REFRIGERATOR DOOR WITH IMPROVED ELECTRICAL OUTLET MOUNTING ARRANGEMENT

[75] Inventors: Francis M. Niekrasz, Palos Park; Gerald J. Bockwinkel, Mundelein, both of Ill.

[73] Assignee: Ardco, Inc., Chicago, Ill.

[21] Appl. No.: 654,370

[22] Filed: Sep. 25, 1984

[51] Int. Cl.[4] ..... E06B 7/12; E05D 7/02

[52] U.S. Cl. ..... 49/70; 49/382

[58] Field of Search ..... 49/382, 70

[56] References Cited

U.S. PATENT DOCUMENTS

| | | | |
|---|---|---|---|
| 3,629,972 | 12/1971 | Rehberg et al. | 49/382 X |
| 3,673,735 | 7/1972 | Winsler et al. | 49/70 |
| 3,724,129 | 4/1973 | Stromquist | 49/70 |

*Primary Examiner*—Philip C. Kannan

*Attorney, Agent, or Firm*—Leydig, Voit & Mayer, Ltd.

[57] ABSTRACT

A refrigerator door construction including a mounting frame having at least one vertical mullion disposed between side members and interconnecting upper and lower members, at least a pair of reversible doors swingably mounted in the frame in selective left- and right-hand operating directions, hinge means for mounting the doors in the frame about a hinge axis disposed along one vertical edge of each of the doors. The doors each having a rearwardly facing recess adjacent the hinge axis substantially centrally between opposite ends of the door, handle means mounted on the other vertical edge of each of the doors substantially centrally between opposite ends thereof and electrical heater means in each of the doors having a flexible cord connected at one end thereto and having plug means at the other end disposed in the recess. Electrical socket means are mounted in the left and right vertical frame members substantially centrally between opposite ends thereof for receiving the plug means when the door hinge axis is disposed adjacent thereto, and selectively reversible electrical socket means are mounted in the mullion substantially between the ends thereof. The reversible socket means is eccentrically mounted in the mullion and is rotatable between positions left and right of the centerline of the mullion for selectively receiving the plug means when the door hinge axis is disposed adjacent the left and right edges of the mullion, respectively.

8 Claims, 12 Drawing Figures

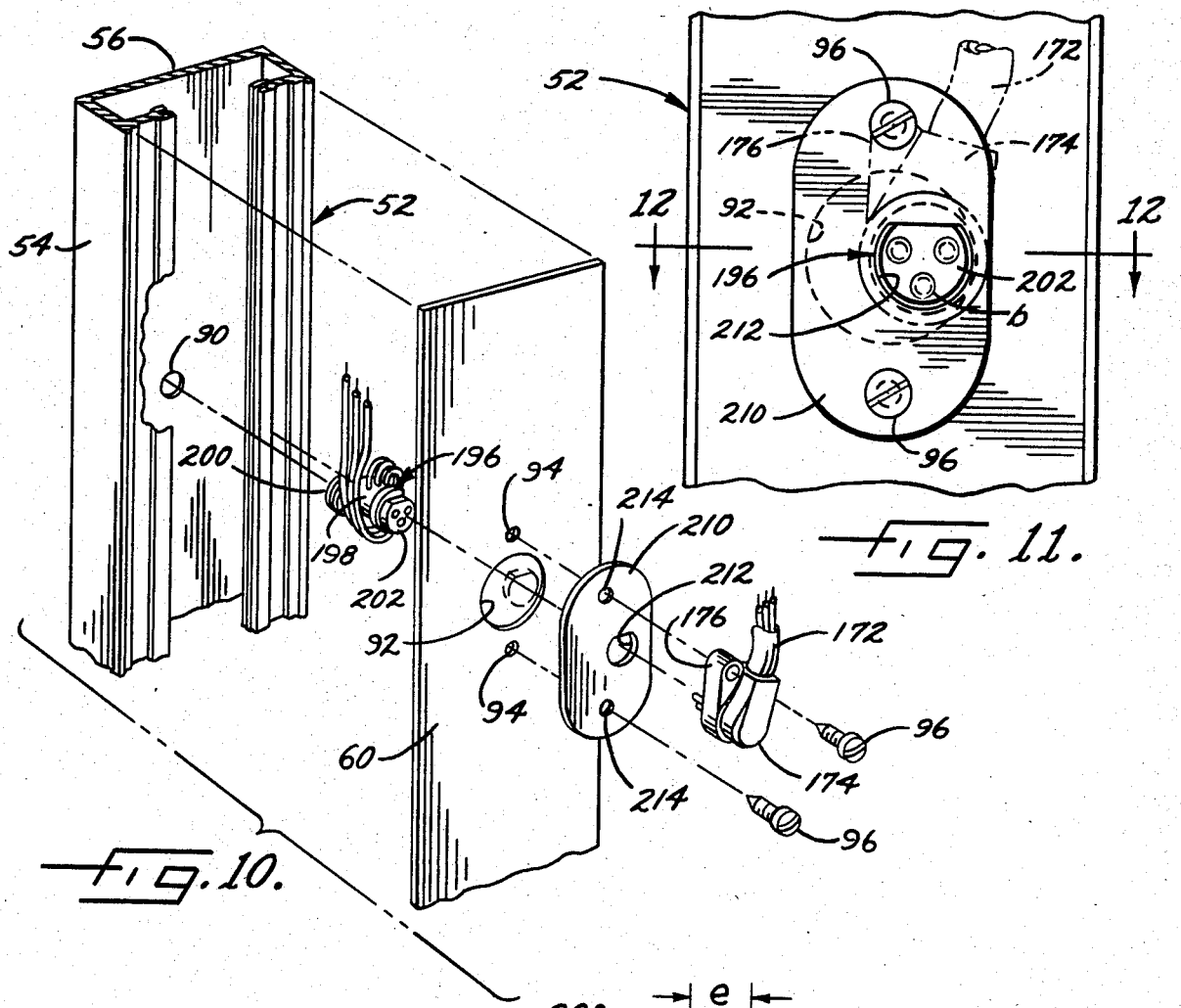
Fig. 10.
Fig. 11.
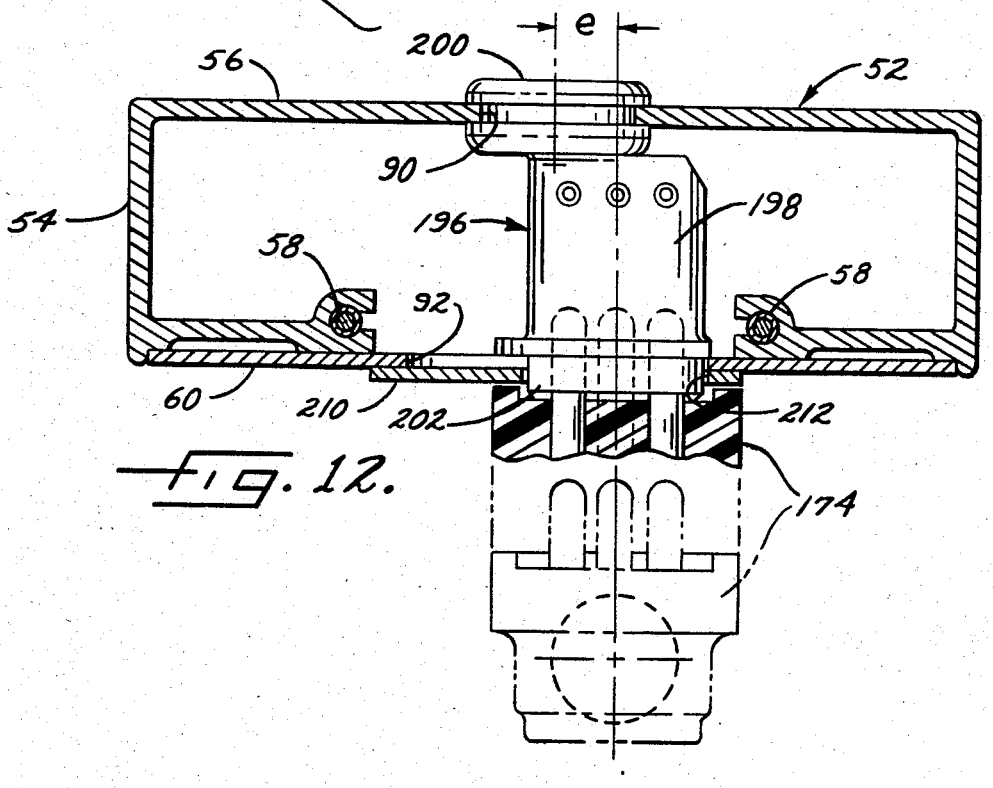
Fig. 12.

REVERSIBLE REFRIGERATOR DOOR WITH IMPROVED ELECTRICAL OUTLET MOUNTING ARRANGEMENT

FIELD OF THE INVENTION

The present invention relates generally to reversible refrigerator doors and more particularly concerns a selectively reversible electrical mounting arrangement for such doors.

BACKGROUND OF THE INVENTION

Many supermarkets and other stores utilize refrigerated display cases. It is desirable to have the refrigerator doors for such cases reversible so they may hinge along either their left- or right-hand sides. A reversible hinge arrangement for such doors is disclosed in U.S. Pat. No. 3,629,972. Such doors are usually electrically heated and it is desirable to provide electrical outlet sockets in the frames on which the doors are hinged.

OBJECTS OF THE INVENTION

It is the primary aim of the present invention to provide a selectively reversible electrical outlet arrangement for reversible refrigerator doors which may be hinged to open either to the left or to the right.

A more specific object is to provide a center frame mullion for refrigerator display cases which includes an eccentrically mounted electrical socket that can be rotated 180° to accommodate an electrical plug of a heated refrigerator door which may be hinged along either the left- or right-hand edge of the mullion.

It is a more detailed object to provide such an eccentric electrical socket with a cover plate which may be used as a crank to rotate the socket about its eccentric mounting.

SUMMARY OF THE INVENTION

A refrigerator door construction is provided including a mounting frame having upper and lower horizontal members, left and right vertical side members and at least one vertical mullion disposed between the the side members and interconnecting the upper and lower members. At least a pair of reversible doors are swingably mounted in the frame in selective left- and right-hand opening directions. Hinge means are provided for mounting the doors in the frame about a hinge axis disposed along one vertical edge of each of the doors, the doors each have a rearwardly facing recess adjacent the hinge axis substantially centrally between opposite ends of the door and handle means mounted on the other vertical edge of the doors substantially centrally between opposite ends thereof. Electrical heater means in each of the doors have a flexible cord connected at one end thereto and the cords have plug means at the other end disposed in the recess. An electrical socket is mounted in the left and right vertical frame members substantially centrally between opposite ends thereof for receiving the plug means when the door hinge axis is disposed adjacent thereto. Selectively reversible electrical socket means are mounted in the center mullion substantially between the ends thereof. The reversible socket means is eccentrically mounted in the mullion and is rotatable between positions left and right of the centerline of the mullion for selectively receiving the electrical plug means when the door hinge axis is disposed adjacent the left and right edges of the mullion, respectively.

BRIEF DESCRIPTION OF THE DRAWINGS

These and other objects and advantages of the invention will become more readily apparent upon reading the following description and upon reference to the accompanying drawings, in which.

DESCRIPTION OF THE PREFERRED EMBODIMENT

Figure 1:
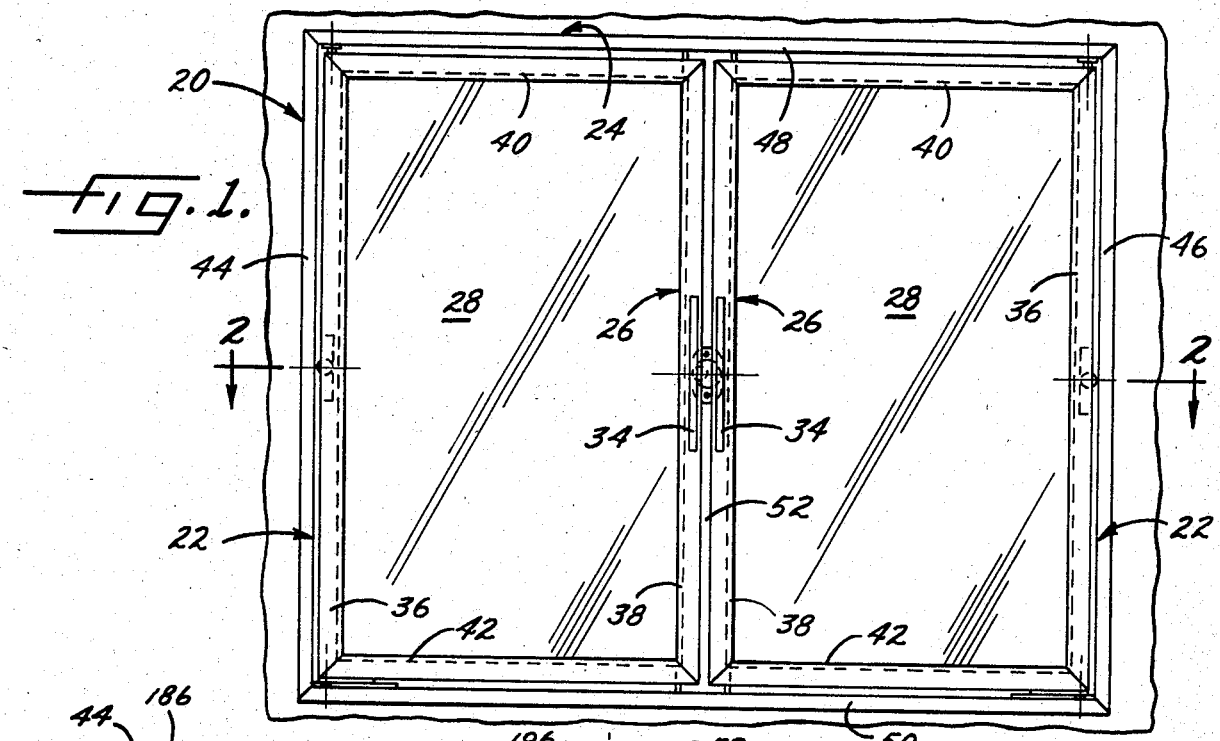
FIG. 1 is a front elevation view of a pair of reversible refrigerator doors according to the present invention, showing the doors opening from the center.

Turning now to FIG. 1, there is shown a refrigerator door construction 20, comprising a pair of refrigerator doors 22 supported in a mounting frame 24. While the illustrated door construction 20 includes two doors 22, it will be understood that in commercial practice, door sets may be supplied with any number of doors, for example one to ten doors, mounted in a single frame. Preferably, the doors 22 may be mounted for either left-hand swing or right-hand swing and are reversible so that they can be mounted to swing in the same direction or oppositely.

Figure 2:
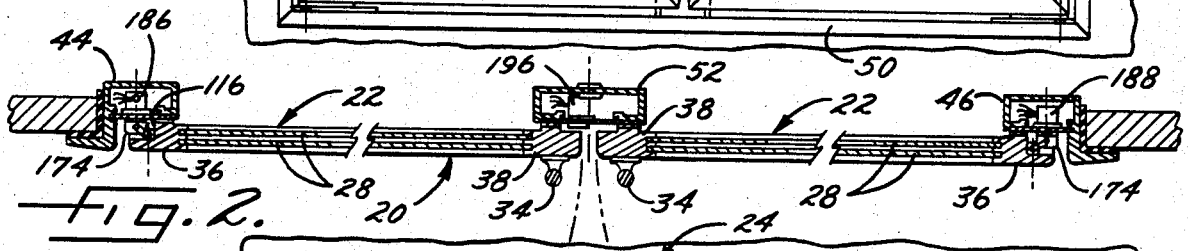
FIG. 2 is an enlarged, fragmentary section taken substantially along line 2—2 in FIG. 1.
Figure 3:
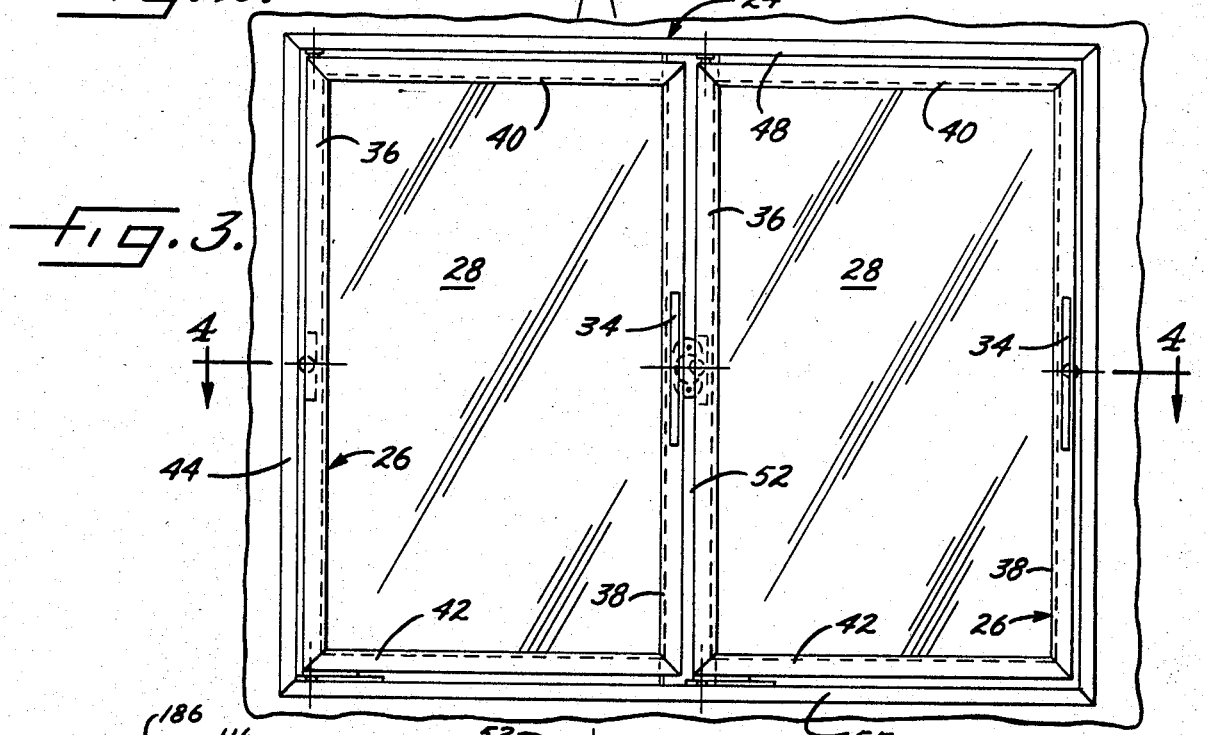
FIG. 3 is a front elevation similar to FIG. 1 showing the refrigerator doors hinged at the left-hand side and opening at the right.
Figure 4:
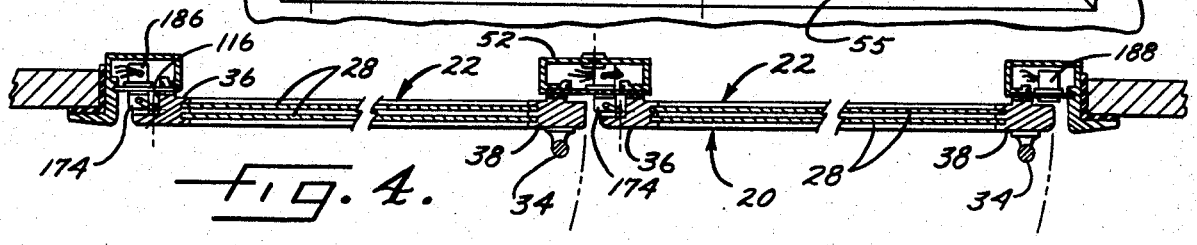
FIG. 4 is a section similar to FIG. 2 taken substantially along line 4—4 in FIG. 3.

As shown in FIGS. 1 and 2 the doors 22 are mounted in the frame 24 to swing open in opposite directions from the center. In FIGS. 3 and 4 the doors 22 are both hinged along their left-hand sides to open from the right.

Each of the illustrated doors 22 comprises a rectangular metal door frame 26 in which a plurality of spaced-apart glass panels 28 are mounted with an insulating air space therebetween. Preferably, the glass panels are tempered and the outer one may have a heat conducting film on its inner surface. The insulating space may be filled with dry air or with an inert gas such as nitrogen.

As shown in FIGS. 1–4, each of the doors 22 is provided with a handle 34 which is used by the customer to open the door. Preferably, the handle 34 is mounted midway between the upper and lower ends of the door and is made sufficiently long to serve equally well when the doors are mounted for either left- or right-hand opening.

The frame 26 for each door 22 includes a hinge side vertical member 36, a handle side vertical member 38 and two horizontal end members 40 and 42. All four members 36–42 are preferably made from aluminum or other extruded alloy metal material so that all have the same cross-sectional shape. The frame members 36–42 may be formed with mitered ends which are suitably joined together to form the rectangular door frame 26.

In the illustrated embodiment, the mounting frame 24 includes vertical left and right side members 44 and 46, and upper and lower horizontal members 48 and 50. All four members 44–50 are preferably made from aluminum or other extrudable alloy metal material so that all have the same cross-sectional shape. The mounting frame members 44–50 may be formed with mitered ends which are suitably joined together to form the rectangular mounting frame 24.

Centrally between the doors 22 there is a vertical member or mullion 52 connected at its ends to the horizontal members 48, 50 at their respective midpoints. In the illustrated construction 20 only one mullion 52 is employed but it will be understood that additional mullions would be employed between adjacent doors if more than two doors are mounted in a single frame 24.

Figure 5:
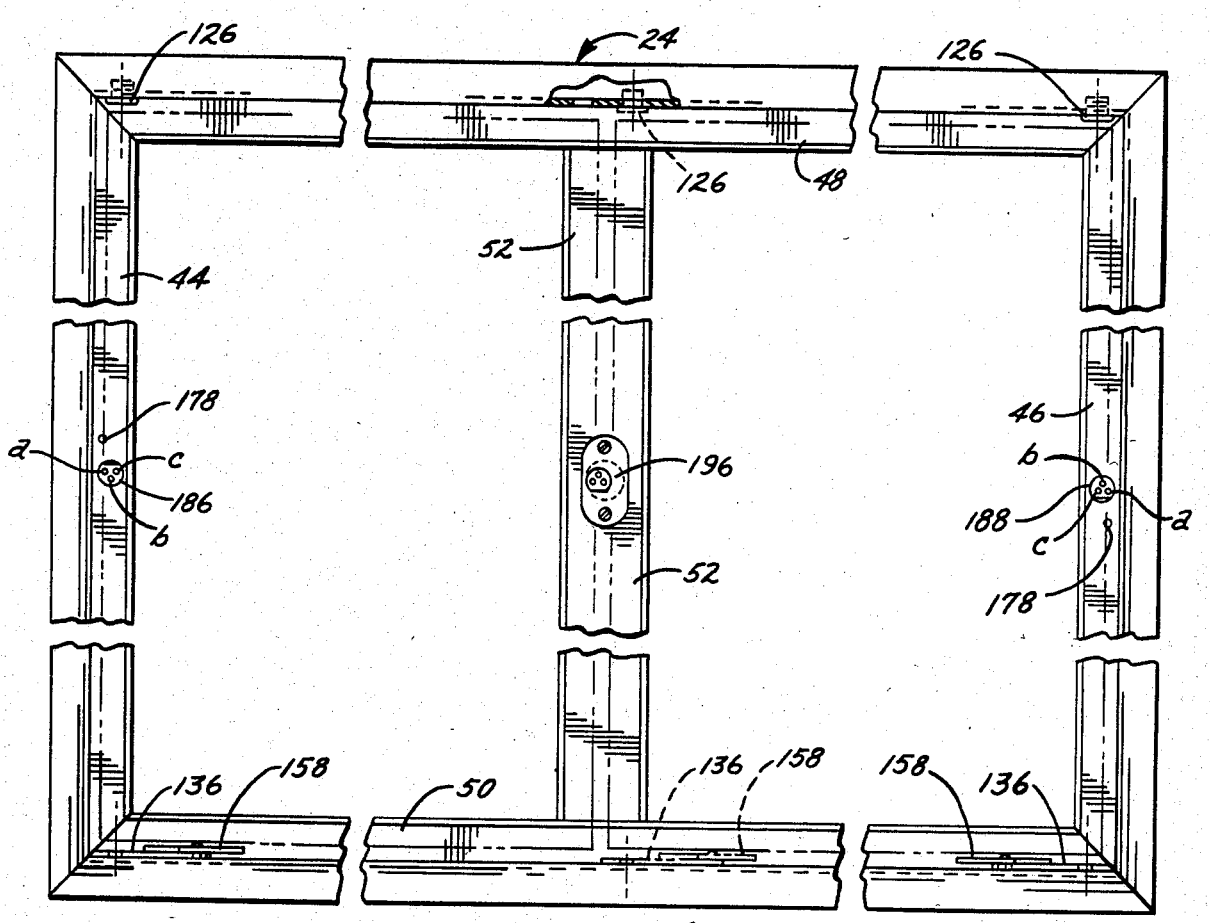
FIG. 5 is an enlarged, fragmentary front elevation of the refrigerator door mounting frame.
Figure 6:
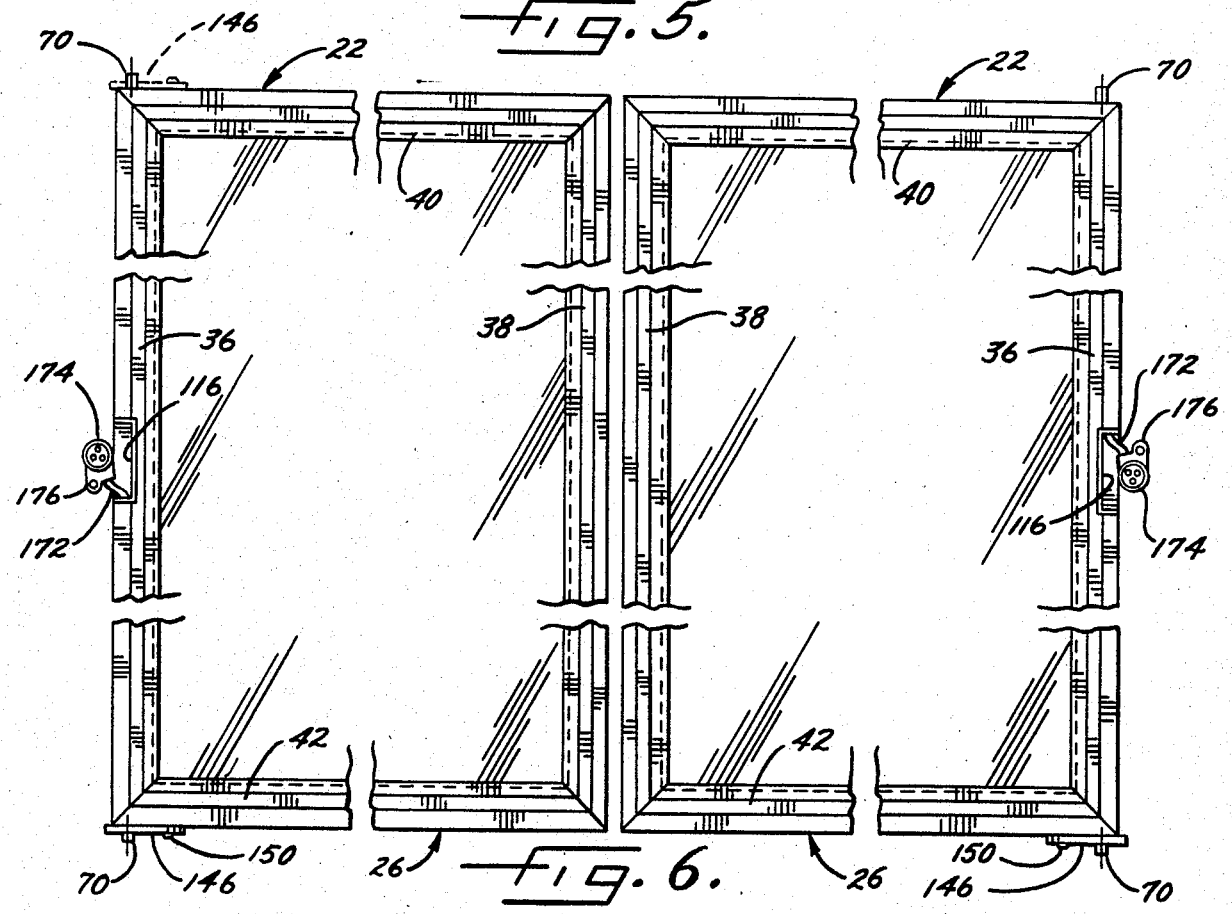
FIG. 6 is an enlarged, fragmentary rear elevation of the reversible refrigerator doors.

In FIG. 5, the front side of the mounting frame 24 is shown with the doors 22 removed (the doors are shown in phantom lines). FIG. 6 shows the backside of the doors 22 as they would appear from the back side of FIG. 1 with the doors unmounted from the frame 24. Thus, to mount the doors 22 in FIG. 6 in the frame 24 of FIG. 5 it would be necessary to rotate the pair of doors 22 in FIG. 6 by 180° from left to right.

To mount the doors 22 in the frame 24 hinge elements are provided on each of the doors and on the mounting frame. In the preferred embodiment, the hinge elements are arranged so that either door can be reversed between left- and right-hand opening positions. Additionally, the hinge elements cooperate with a closure spring (not shown) in each door so that the door is resiliently urged to its closed position.

Preferred forms of the hinge elements and closure spring are illustrated and described in detail in U.S. Pat. No. 3,629,972, which is incorporated herein by reference. Suffice it to say here that the doors include upper and lower hinge pins 70 which are respectively received in openings in upper hinge sockets 126 and lower hinge mounting plates 136 removably secured to the upper and lower frame members 48 and 50

The hinge pins 70 may be provided with square ends to fit into square openings in the upper sockets 126 and lower mounting plates 136 so as to actuate the closure springs as described in the aforementioned patent. Also, the lower hinge pins project through lower stop plates 146 which are removably secured to the lower end of the doors 22 such as by a suitable screw 150. To keep the door open at about a 90° angle a slidable latch member 158 is mounted on the lower mounting plate 136 and is selectively engageable with the stop plate 146 mounted on the door 22.

As previously mentioned each of the doors is preferably provided with an internal heating means such as an electrically conductive film applied to the inner surface of the outer glass panel 28. To energize the heating film a flexible electrical cord 172 is connected thereto. The cord is contained within the hollow door member 36 which is formed with a rearward facing recess 116 substantially midway between its ends. The other end of the cord 172 is provided with a polarized plug 174 through which an electrical connection can be made to energize the internal heating element.

Polarized electrical sockets 186, 188 are located in each of the vertical mounting frame members 36, 38 and are connected to an appropriate electrical source (not shown). Referring to FIG. 5, it will be seen that each of the sockets 186, 188 have three prong-receiving openings, a, b and c, the middle one of which is disposed eccentrically. Thus, the opening b in socket 186 is located below the center line while the opening b in socket 188 is located above the center line.

As previously mentioned, the doors 22 in FIG. 6 are shown from the back side and to mount the doors 22 in the frame 24 of FIG. 5, the doors are rotated 180° out from the plane of the drawing into the position shown in FIGS. 1 and 2. It will be appreciated, therefore, that the plugs 174 located in the recesses 116 are inserted in the sockets 186, 188 in the left- and right-hand frame members 36, 38. Preferably, each plug 174 includes an eccentric mounting tab 176 through which a suitable fastening screw may be inserted and screwed into an opening 178 in the mounting frame members 36, 38, which are identical but are disposed 180° end-to-end with respect to one another.

In FIG. 5, the frame 24 is arranged to receive the doors 22 to open in the center as shown in FIG. 1. Thus, the upper hinge sockets 126 (shown in solid lines) are located at the left- and right-hand ends of the upper mounting frame member 48. Likewise, the lower mounting plates 136 (shown in solid lines) are located at the left- and right-hand ends of the lower mounting frame member 50. In other words, the left door is hinged on the left on a hinge axis along vertical frame member 44 and the right door is hinged on the right on a hinge axis along vertical frame member 46. As shown in FIG. 2, the plugs 174 are inserted in the left- and right-hand sockets 186 and 188, respectively.

Pursuant to the present invention a selectively reversible socket 196 is mounted in the center mullion 52 to receive the plug 174 when it is desired to have one of the doors, 22 hinged on the mullion. This is the arrangement shown in FIGS. 3 and 4. To accomplish this, it is necessary to move the upper right-hand hinge socket 126 to adjacent the center mullion 52 (as shown in phantom in FIG. 5). Likewise, it is necessary to relocate the lower mounting plate 136 and slidable latch member 158 from the lower right-hand position to adjacent the center mullion 52 (as shown in phantom in FIG. 5). Additionally, it is necessary to reposition the stop plate 146 on the door 22 from the lower left-hand position shown in FIG. 6 to the left right hand corner of the door 22 (as shown in phantom in FIG. 6).

Figure 7:
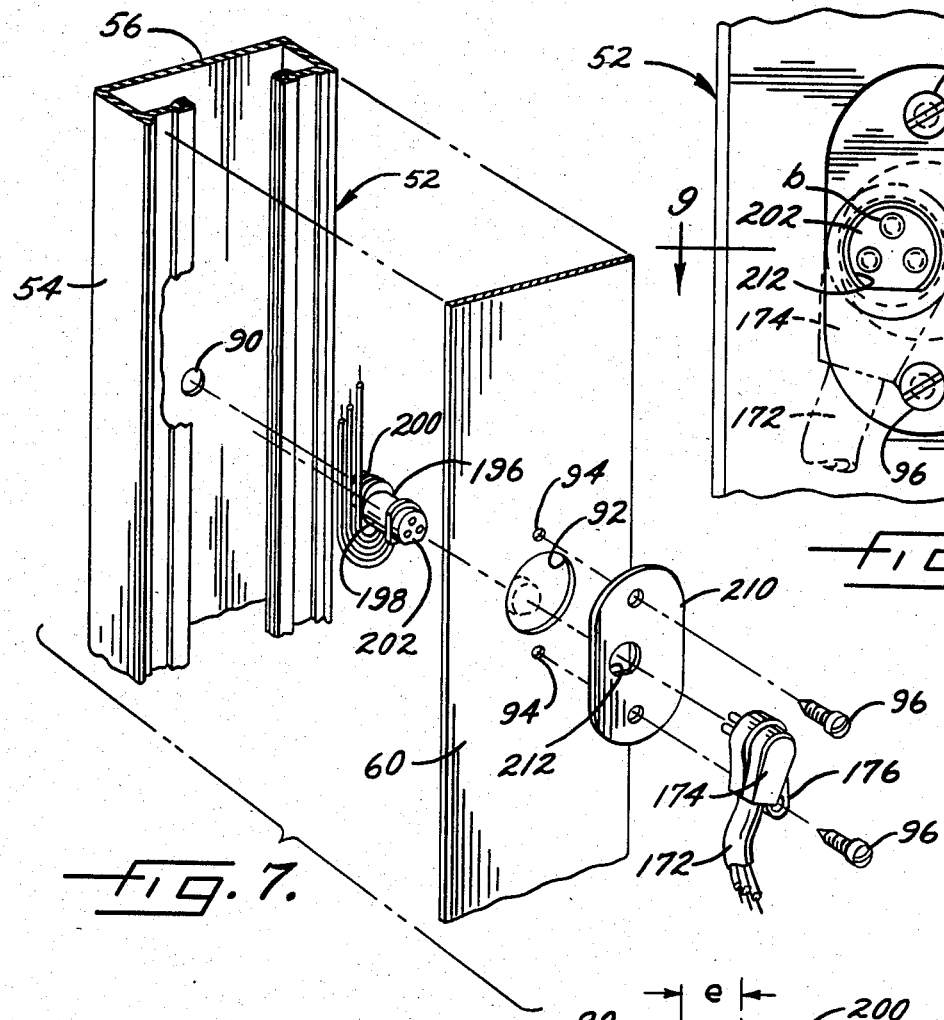
FIG. 7 is an exploded isometric view of the selectively reversible electrical socket of the present invention.
Figure 8:
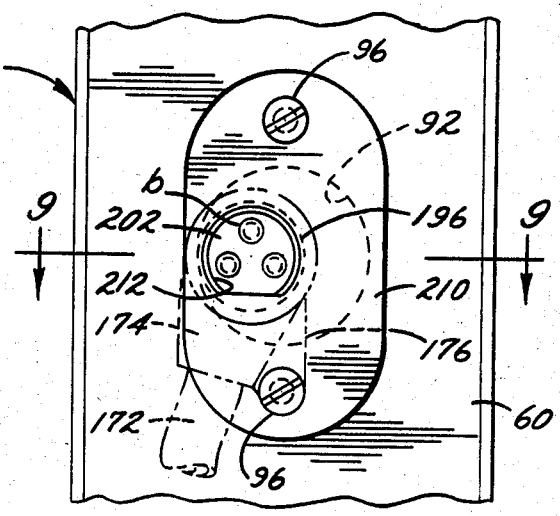
FIG. 8 is an enlarged front elevation of the electrical socket and mounting plate shown in FIG. 7.
Figure 9:
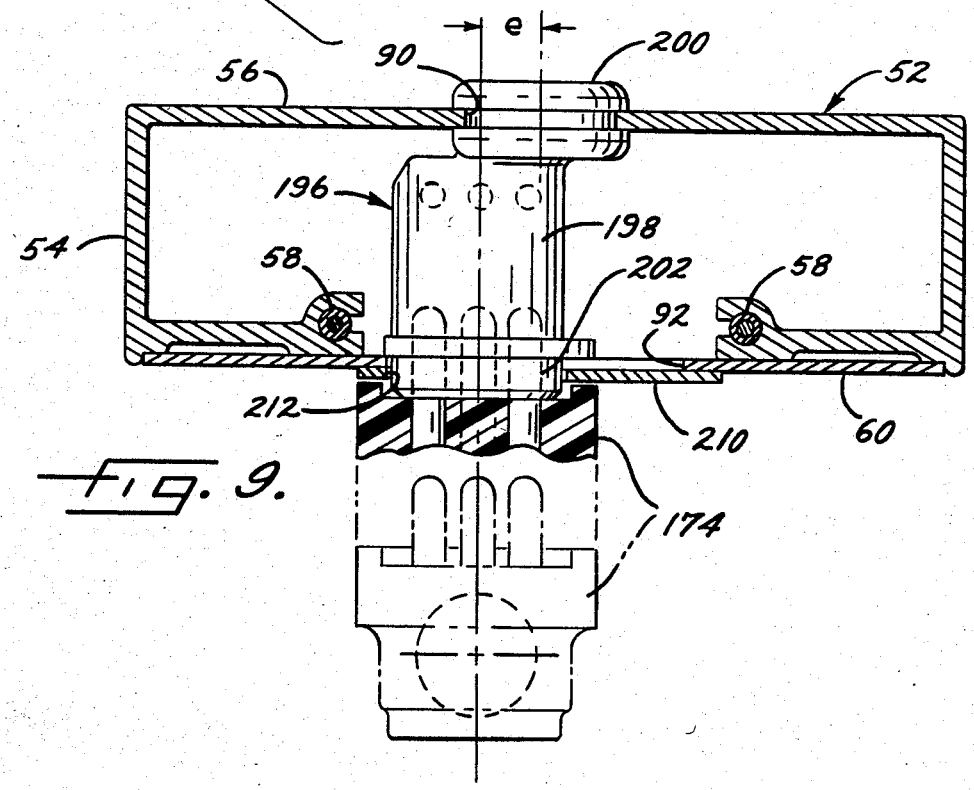
FIG. 9 is a still further enlarged section taken substantially along line 9—9 in FIG. 8; and, FIGS. 10–12 are views similar to FIGS. 7–9 showing the electrical socket reversed 180°.

In accordance with the invention, the reversible socket 196 is eccentrically mounted on the center mullion 52. FIGS. 7–9 show the socket 196 as it is assembled in the factory and appears in FIGS. 1, 2 and 5. As shown in FIGS. 7 and 9 the mullion 52 is generally box-shaped having a channel-shaped base 54 with a back panel 56 preferably made from aluminum or other alloy metal material. The channel 54 is formed to contain heating elements 58 and is closed at its front by a front panel 60.

The socket 196 includes a body portion 198, an eccentric rear portion 200 and a front plug receiving portion 202 aligned axially with the body 198. The back panel 56 of the mullion is provided with a centrally disposed aperture 90 for receiving the eccentric end 200 of the socket 196. The front panel 60 is formed with an enlarged opening 92 and a pair of mounting holes 94 which receive fastening means shown here as screws 96.

To hold the socket 196 in the mullion 52 and position it in its proper orientation, a mounting plate 210 is provided. As best seen in FIGS. 7 and 8, the plug receiving portion 202 of the socket 196 is non-circular in shape, having a flat opposite the opening b. Likewise, the mounting plate 210 is formed with a complementary non-circular opening 212 for receiving the front portion 202 of the socket. The mounting plate 210 is also provided with holes 214 through which the fastening screws 96 are inserted.

In keeping with the invention, the non-circular opening 212 in the mounting plate 210 is eccentrically located with respect to the vertical center line of the plate. Thus, as shown in FIGS. 7–9 when the socket 196 is installed in the mullion 52 with the cover plate 210 in place, the plug receiving end 202 of the socket is disposed to the left of the centerline of the mullion by a distance e representing the eccentricity of the rear portion 200 of the socket 196. It will also be noted that the plug receiving end 202 of the socket 196 is disposed in the left-hand portion of the enlarged opening 92 in the front panel 60 of the mullion 52. The fastening screws 96 are inserted through the holes 214 in the mounting plate 210 and screwed into the openings 94 in the front panel 60 of the mullion 52. It will be noted that the lower screw 96 is inserted through the opening in the mounting lug 176 on the plug 174 to keep the plug securely in place.

When it is desired to hinge one of the doors 22 along the right-hand side of the center mullion 52, it is a simple matter to reposition the selectively reversible socket 196. First, the lower screw 96 (FIG. 7) and the plug 174 are removed and the door 22 is lifted off its lower mounting plate 136 and then lowered away from the upper hinge socket 126. The upper screw 96 (FIG. 7) is then removed and the mounting plate 210 can be used as a crank to rotate the socket 180° clockwise to the position shown in FIGS. 10–12 wherein it is offset eccentrically to the right of the centerline of the mullion 52. The lower screw 96 is then reinserted through the mounting plate 210 and after the door 22 is rehung in the frame 24, the plug 174 is reinserted in the socket 196. This is the position shown in FIGS. 3–4 and 10–12.

From the foregoing it will be seen that an improved electrical mounting arrangement is provided for reversible refrigerator doors. The socket 196 can be prewired and installed in the center mullion in the position shown in FIGS. 1, 2, 5 and 7–9. This position also accommodates hinging a door along the left side of the center mullion (position not shown). When it is desired to hinge one of the doors 22 along the right side of the center mullion as shown in FIGS. 3 and 4 the selectively reversible socket 174 is rotated from the factory installed position shown in FIGS. 7–9 to the field installation position shown in FIGS. 10–12. As noted above, the mounting plate 210 may be used as a crank to rotate the socket 174 about its eccentric end portion 200. It will be appreciated that the socket 174 need not be removed from the mullion. Thus, there is no danger that it will fall away from the opening 92 in the front panel 60 which would require either fishing for the socket or removal of the front panel itself.

We claim as our invention:

1. A refrigerator door construction comprising, in combination, a mounting frame having upper and lower horizontal members, left and right vertical side members and at least one vertical mullion disposed between said side members and interconnecting said upper and lower members, at least a pair of reversible doors swingably mounted in said frame in selective left- and right-hand opening directions, hinge means for mounting said doors in said frame about a hinge axis disposed along one vertical edge of each of said doors, said doors each having a rearwardly facing recess adjacent said hinge axis substantially centrally between opposite ends of said door, handle means mounted on the other vertical edge of each of said doors substantially centrally between opposite ends thereof, electrical heater means in each of said doors and having a flexible cord connected at one end thereto, said cord having plug means at the other end disposed in said recess, electrical socket means mounted in said left and right vertical frame members substantially centrally between opposite ends thereof for receiving said plug means when said door hinge axis is disposed adjacent thereto, and selectively reversible electrical socket means mounted in said mullion substantially between the ends thereof, said reversible socket means being eccentrically mounted in said mullion and being rotatable between positions left and right of the centerline of said mullion for selectively receiving said plug means when said door hinge axis is disposed adjacent said left and right edges of said mullion, respectively.

2. The combination defined in claim 1 wherein said reversible socket includes a body having an eccentric mounting portion receivable in an aperture located substantially symmetrically in said mullion.

3. The combination defined in claim 2 wherein said mullion is generally box-shaped in cross-section and said aperture is located in the rear panel thereof.

4. The combination defined in claim 3 wherein said socket includes an axially projecting plug receiving end and said mullion includes a front panel having an enlarged opening therein through which said plug receiving end of said socket projects.

5. The combination defined in claim 4 wherein said plug receiving end of said socket is non-circular in shape and including a cover plate having a corresponding non-circular opening eccentrically located therein for receiving said non-circular socket end.

6. The combination defined in claim 5 wherein said cover plate and said mullion front panel are provided with fastening means located symmetrically about said enlarged opening whereby said cover plate and socket may be rotated such that said non-circular socket end is disposed either to the left or right of the centerline of said mullion.

7. The combination defined in claim 6 wherein said cover plate is adapted for use as a crank arm for rotating said socket between said eccentric left and right positions.

8. The combination defined in claim 5 wherein said plug is formed with an apertured lug for receiving one of said cover plate fastening means.

* * * * *